US007178754B2

(12) United States Patent
Anderson

(10) Patent No.: US 7,178,754 B2
(45) Date of Patent: Feb. 20, 2007

(54) BALLOON ANCHOR

(75) Inventor: Brent Anderson, Barrington, IL (US)

(73) Assignee: CTI Industries Corporation, Barrington, IL (US)

( * ) Notice: Subject to any disclaimer, the term of this patent is extended or adjusted under 35 U.S.C. 154(b) by 0 days.

(21) Appl. No.: 10/124,940

(22) Filed: Apr. 17, 2002

(65) Prior Publication Data

US 2003/0197084 A1 Oct. 23, 2003

(51) Int. Cl.
*B65H 75/28* (2006.01)

(52) U.S. Cl. ..... 242/402; 242/404.3; 242/405.1; 242/587.2; 242/614; 242/580

(58) Field of Classification Search ..... 242/402, 242/404.3, 405.1, 407, 587.2, 614, 388.2, 242/580
See application file for complete search history.

(56) References Cited

U.S. PATENT DOCUMENTS 2,683,937 A * 7/1954 Criswell ..... 33/393
4,195,794 A * 4/1980 Ricci et al. ..... 242/396.9
4,779,816 A * 10/1988 Varlet ..... 242/405.1
4,917,323 A * 4/1990 Wing ..... 242/405.1
4,936,532 A 6/1990 Williams
4,993,664 A 2/1991 Kneeland
5,035,391 A 7/1991 Steele et al.
5,074,510 A 12/1991 Metz
5,188,314 A 2/1993 Peters
5,240,199 A 8/1993 Peters
5,255,866 A * 10/1993 Campolo ..... 242/388.1
5,259,805 A 11/1993 Kieves
5,265,822 A * 11/1993 Shober et al. ..... 242/388.2
5,411,427 A 5/1995 Nelson et al.
5,628,091 A 5/1997 Mueller
5,662,510 A 9/1997 Wolens
5,755,419 A 5/1998 Gearhart et al.
5,797,783 A 8/1998 Harris
D401,255 S 11/1998 Burns et al.
D414,222 S 9/1999 Kieves et al.
5,957,401 A * 9/1999 O'Donnell ..... 242/404.3
D415,841 S 10/1999 Kieves et al.
5,989,093 A 11/1999 Nelson et al.
6,065,709 A * 5/2000 Wagter et al. ..... 242/388.1
6,076,758 A 6/2000 Kieves et al.
6,164,582 A * 12/2000 Vara ..... 242/395
6,286,777 B1 * 9/2001 Black ..... 242/388.6
6,431,489 B1 * 8/2002 Rose ..... 242/405.2
6,497,381 B2 * 12/2002 Rose ..... 242/402
2001/0034176 A1 10/2001 Deliu

FOREIGN PATENT DOCUMENTS

GB 2130552 A * 6/1984

* cited by examiner

*Primary Examiner*—Kathy Matecki
*Assistant Examiner*—Sang Kim
(74) *Attorney, Agent, or Firm*—Joseph A. Fuchs; Everest Intellectual Property Law Group

(57) ABSTRACT

The present invention provides a balloon anchor including a spool having opposing sides, a pair of flanges, one flange extending from each opposing side of the spool, at least one of the flanges having a cutout section, the cutout section having a first side and a second side; and a hook extending from the second side of the cutout section.

19 Claims, 3 Drawing Sheets

BALLOON ANCHOR

BACKGROUND OF THE INVENTION

The present invention relates to an anchor for fixedly tethering a balloon. Balloons, including lighter-than-air balloons, are well-known in the art. Lighter-than-air balloons are used for decorations at parties, given as gifts, and presented to persons with floral or other arrangements at special occasions such as graduations, birthdays, Valentine's Day, and Mothers' Day. Such balloons often bear an indicia of the occasion, such as "Happy Birthday," "Over the Hill," or "Congratulations."

Lighter-than-air balloons are typically filled with helium, but may be filled with any lighter-than-air gas. Thus, the balloons float in air. The balloons may be made from a variety of materials, including natural or synthetic rubber, polyester, metallized polyester, nylon, or metallized nylon. If untethered, the balloons would float uncontrolled.

Often, for display in retail stores, balloon weights have been employed, with the balloon attached to the weight by a string or ribbon. Weights, however, may be unsightly, and string or ribbon must be tied to the weight. Balloons are also sometimes tied to any stable object to prevent them from floating away. Tying and untying balloons when a customer purchases them is time-consuming for the store clerk.

Balloon weights have been developed that have a pre-assembled weight, a length of ribbon, and sometimes a means to attach the balloon to the ribbon. Examples of such weights are disclosed in U.S. Pat. Nos. 5,989,093 and 6,076,758. These prior art balloon weights often have hooks extending from them, and are adapted to be hung from a peg. The hooks have the potential to break off, thus defeating the purpose of the balloon weight. Moreover, extending the hook from the body of the weight increases difficulty in using automation to package such weights.

SUMMARY OF THE INVENTION

The present invention provides a balloon anchor including a spool having opposing sides, a pair of flanges, one flange extending from each opposing side of the spool, one of the flanges having a cutout section, the cutout section having a first side and a second side, and a hook extending from the second side of the cutout section.

In another embodiment, the balloon anchor has a spool having opposing sides, a pair of flanges, one flange extending from each opposing side of the spool, each flange having a cutout section, each cutout section having a first side and a second side, and a hook extending from the second side of each cutout section.

A further embodiment of the balloon anchor includes a spool having opposing sides, a pair of flanges, one flange extending from each opposing side of the spool, each flange having a plurality of cutout sections, the cutout sections having a first side and a second side, and a hook extending from the second side of each cutout section.

In a still further embodiment of the present invention, the balloon anchor has a spool having opposing sides, a pair of flanges, one flange extending from each opposing side of the spool, one of the flanges having a plurality of cutout sections, each cutout section having a first side and a second side, a hook extending from the second side of each cutout section.

The balloon anchor of the present invention does not have an external hook. The hook of the present invention is located within the perimeter of the flange. Thus, the hook is less likely to break off during use, and is also more easily packaged using automation than weights having an extended hook. Additional features and advantages of the present invention are described in, and will be apparent from, the following Detailed Description of the Invention and the figures.

DETAILED DESCRIPTION OF THE INVENTION

Figure 1:
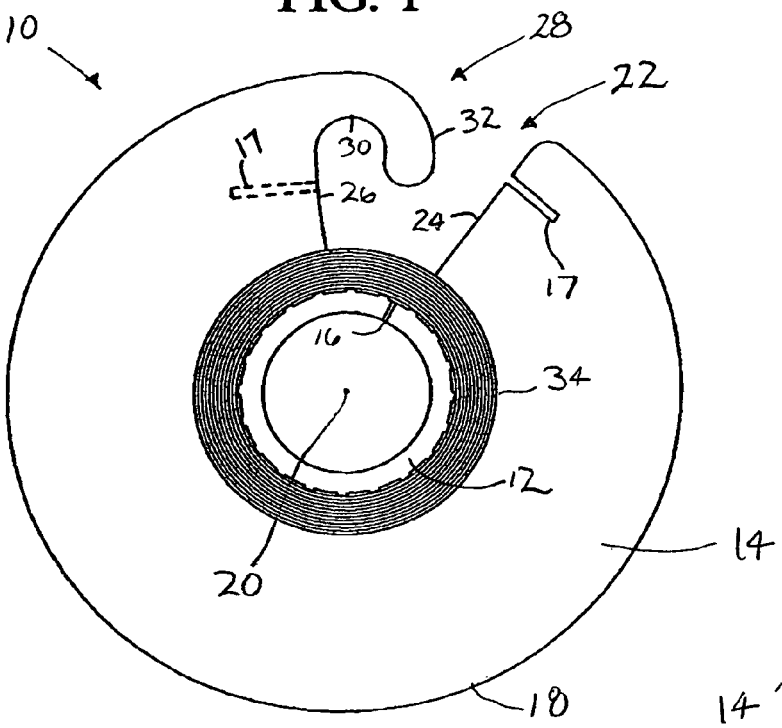
FIG. 1 is a side view of one embodiment of the balloon anchor of the present invention.
Figure 2:
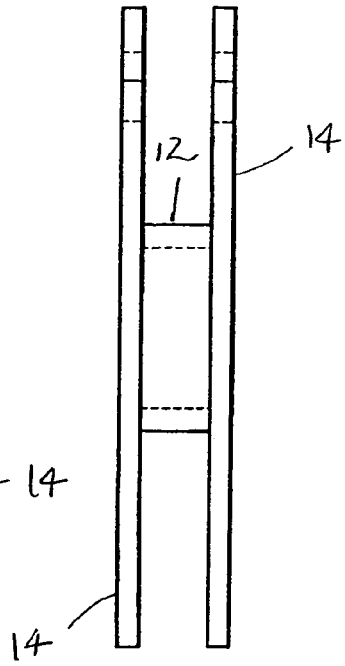
FIG. 2 is an end view of the balloon anchor of FIG. 1.

FIGS. 1 and 2 illustrate one embodiment of the balloon anchor 10 of the present invention. The balloon anchor 10 has a spool 12. The spool 12 may be hollow or solid. Attached to each side of the spool 12 are flanges 14. The spool 12 is preferably cylindrical in shape, but may be any suitable shape. The spool 12 may have a notch 16 in one or both if its sides. The flanges 14 are preferably circular having a perimeter 18. The flanges 14 are attached to each side of the spool 12 such that the spool 12 and flanges 14 have a common center point 20.

At least one of the flanges 14, but preferably both flanges 14, have a cutout section 22. This embodiment will be described with both flanges 14 having a cutout section 22. Each cutout section 22 has a first side 24 that extends substantially along a radius from the center point 20. Each cutout section 22 also has a second side 26 that extends substantially along a radius from the center point 20.

Extending from the second side 26 of each cutout section 22 is a hook 28. Each hook 28 is generally U-shaped, and defines a base 30 and leg 32. The leg 32 of each hook 28 extends inwardly, i.e., generally toward the center point 20 from the perimeters 18 of the flanges 14. If both flanges 14 have a cutout section 22, the hooks 28 of each flange 14 should be similarly oriented and in substantial registration with one another. The notch 16 is preferably located on one or both sides of the spool 12 within at least one cutout section 22. Preferably a second notch 17 may be located along either one or both of the first side 24 or second side 26, on the bases 30, or on legs 32. One or more notches 17 may also be located at any suitable point along the perimeter 18 of one or both flanges 14.

Figure 5:
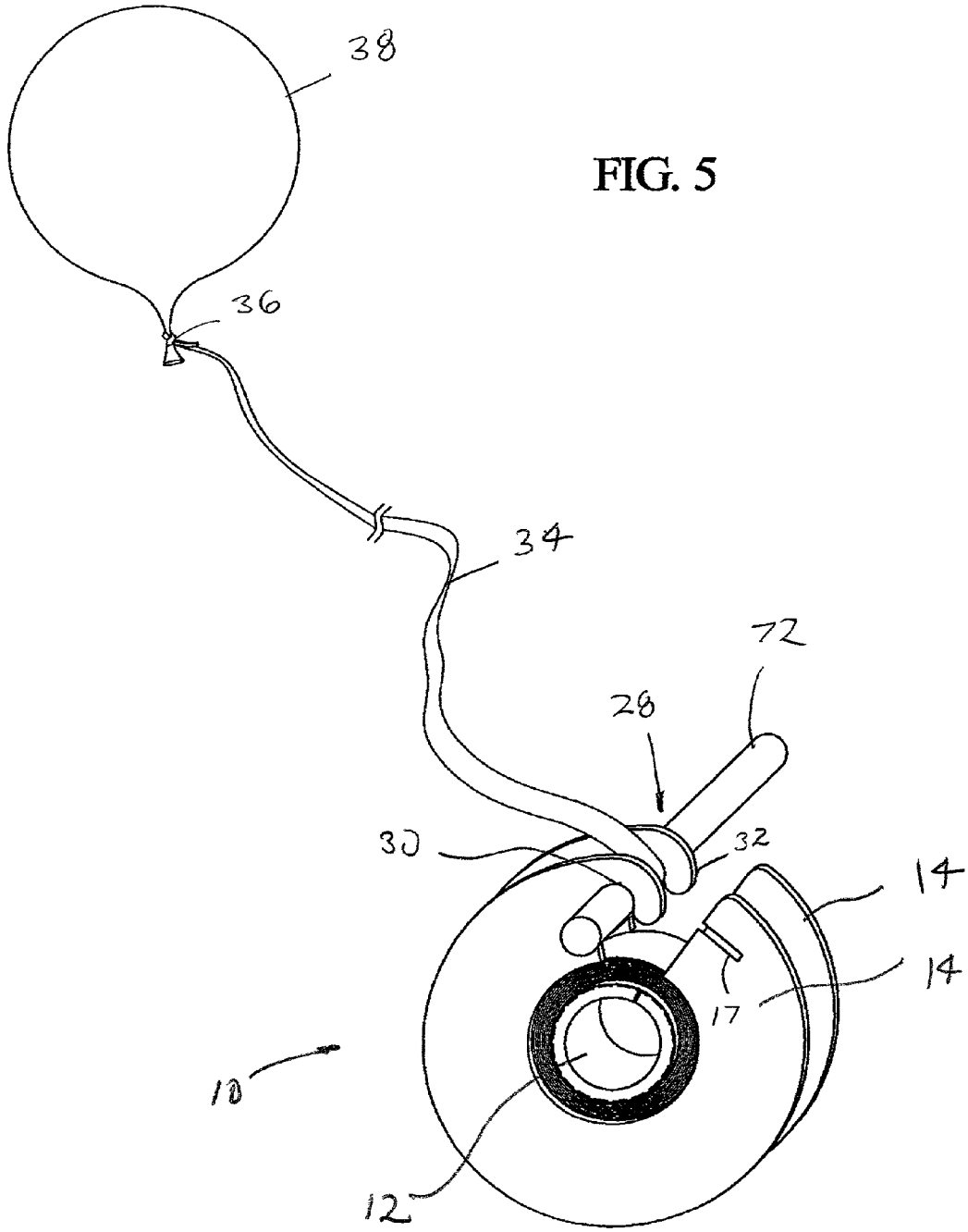
FIG. 5 shows one embodiment of the present invention anchoring a balloon.
Figure 6:
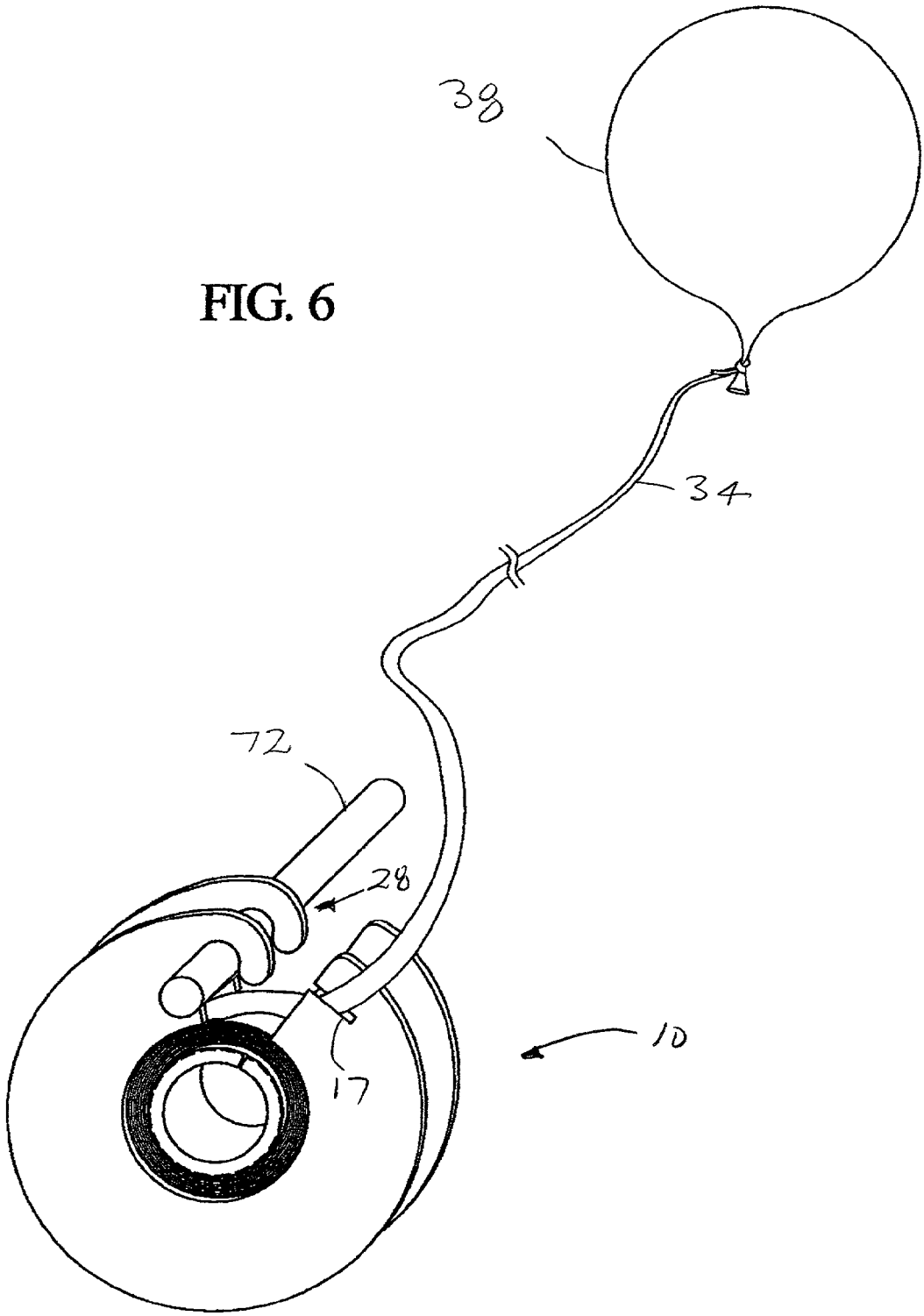
FIG. 6 shows another embodiment of the present invention anchoring a balloon.

A ribbon 34 is wrapped around the spool 12. The ribbon 34 has a first end (not shown) secured to the spool 12 by any suitable means, including taping the first end to the spool 12. The first end of the ribbon 34 may also extend through the notch 16 and a knot tied in the first end of the ribbon 34. The ribbon 34 also has a second end 36 that is attached to a balloon 38. (FIGS. 5 and 6.) While a ribbon is preferred, a string or any similar suitable material may be used. The balloon anchor 10 is preferably made of a plastic material, but may be any suitable material and size having sufficient mass to act as an anchor to overcome the buoyancy force of the balloon 38.

Figure 3:
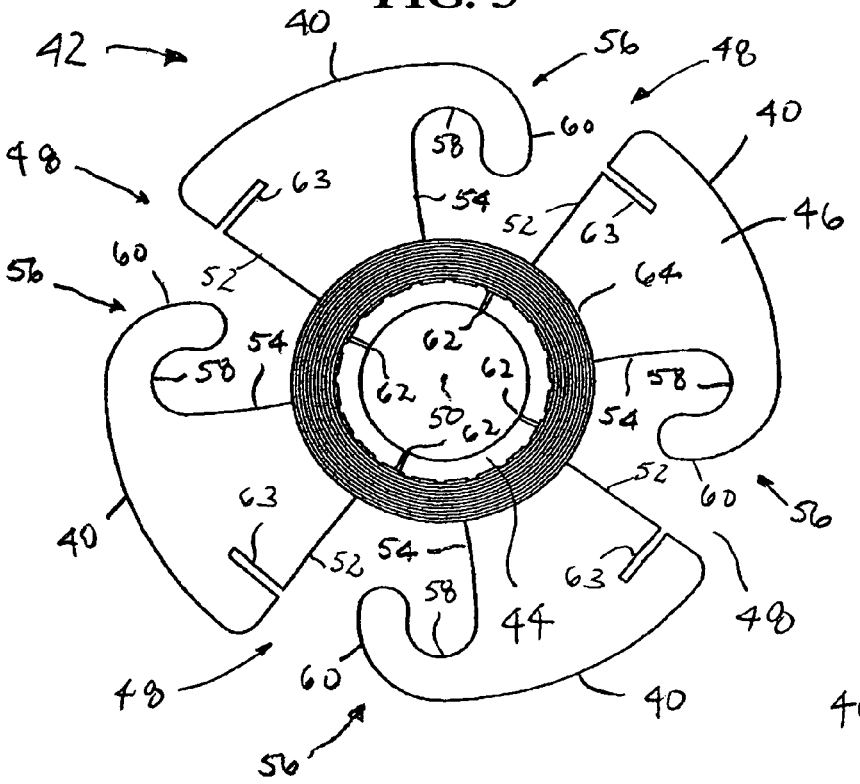
FIG. 3 is a side view of another embodiment of the balloon anchor of the present invention.
Figure 4:
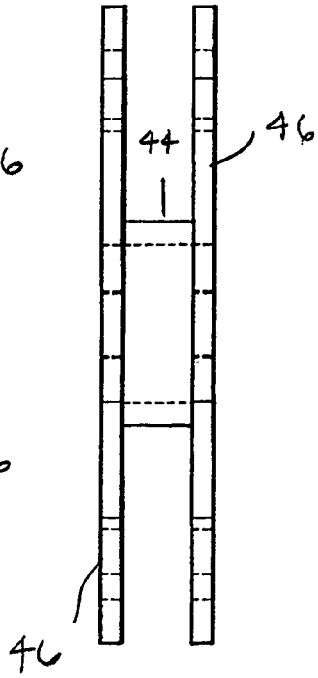
FIG. 4 is an end view of the balloon anchor of FIG. 3.

FIGS. 3 and 4 illustrate a second embodiment of the balloon anchor 42 of the present invention. Like the embodiment of FIGS. 1 and 2, balloon anchor 42 has a spool 44 and flanges 46 extending from each side of the spool 44. The spool 44 is preferably cylindrical, but may be any suitable shape. The flanges 46 are preferably circular each having a perimeter 40. The flanges 46 are attached to each side of the spool 44 such that the spool 44 and flanges 46 have a common center point 50.

At least one of the flanges 46, but preferably both flanges 46, have a plurality of cutout sections 48. This embodiment will be described with both flanges 46 having a plurality of cutout sections 48. FIG. 3 shows an embodiment with four cutout sections 48, though the invention contemplates any desired number of cutout sections 48, depending on the size of the balloon anchor 42. The multiple cutout sections 48 each have a first side 52 that extend substantially along a radius from the center point 50. Each cutout section 48 also has a second side 54 that extends substantially along a radius from the center point 50.

Extending from each second side 54 of each cutout section 48 is a hook 56. Each hook 56 is generally U-shaped and defines a base 58 and leg 60. The leg 60 of each hook 56 extends inwardly, i.e., generally toward the center point 50 from the perimeter 40 of the flanges 46. If both flanges 46 have cutout sections 48, the hooks 56 of each flange 46 should be similarly oriented and in substantial registration with one another. A notch 62 may be located on one or both sides of the spool 44 within each cutout section 48. Alternatively, a second notch 63 may be located along one or both of the first side 52 or second side 54, on the base 58, or on leg 60. One or more notches 63 may also be located at any suitable point along the perimeter 40 of one or both flanges 46.

A ribbon 64 is wrapped around the spool 44. The ribbon 64 has a first end (not shown) secured to the spool 44 by any suitable means, including taping the first end to the spool 44. The first end of the ribbon 64 may also extend through the notch 62 and a knot tied in the first end of the ribbon 64. The ribbon 64 also has a second end that is attached to a balloon as in FIGS. 5 and 6. While a ribbon is preferred, a string or any suitable material may be used. The balloon anchor 42 is preferably made of a plastic material, but may be any suitable material and size having sufficient mass to act as an anchor to overcome the buoyancy force of the balloon 38.

FIG. 5 shows one way in which the balloon anchor 10 secures a balloon 38. It is contemplated that although FIGS. 5 and 6 are described with respect to the first embodiment of the balloon anchor 10, the same principles apply to the second embodiment of the present invention 42. During display, the balloon anchor 10 is suspended by hooks 28 extending from each flange 14 around a peg 72. The bases 30 of the hooks 28 rest on the peg 72. The legs 32 of the hooks 28 wrap partially around the peg 72. The peg 72 can be any suitable peg including a tack, nail, pin, or a wire.

The ribbon 34 wrapped around the spool 12 is attached at its second end 36 to a balloon 38. The ribbon 34 is wrapped around the spool 12 such that when the balloon anchor 10 is hung from the peg 72, the ribbon 34 is impeded from extending by contact with the peg 72, thus securing the balloon.

FIG. 6 shows an alternative way in which the balloon anchor 10 secures a balloon 38. As in FIG. 5, the balloon anchor 10 of FIG. 6 is suspended on peg 72 by hooks 28. In FIG. 6, the ribbon 34 is placed in the notch 17, which prevents the ribbon 34 from extending, and secures the balloon. As stated above, the notch 17 may be located along either the first side 24 or second side 26 as (shown dashed in FIG. 1, for example), on the base 30, or the leg 32. The notch 17 may also be located at any suitable point along the perimeter 18 of one or both flanges 14.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A balloon anchor comprising:

a spool having opposing sides;

a pair of flanges, one flange extending from each opposing side of the spool;

one of the flanges having a cutout section, the cutout section having a first side and a second side and a first notch, wherein the first notch is located on a winding surface of the spool; and a hook extending from the second side of the cutout section.

2. The balloon anchor of claim 1 wherein the spool is adapted to receive a ribbon.

3. The balloon anchor of claim 1 wherein the hook is generally U-shaped defining a base and a leg, and wherein the leg extends toward the spool.

4. The balloon anchor of claim 1 wherein a second notch is located on the first side of the cutout section.

5. A balloon anchor comprising:

a spool having opposing sides;

a pair of opposed flanges, one flange extending from each opposing side of the spool;

each flange having a cutout section in registration with the other cutout section, each cutout section having a first side and a second side and a notch, wherein said first notch is located on a winding surface of the spool; and a hook extending from the second side of each cutout section.

6. The balloon anchor of claim 5 wherein the spool is adapted to receive a ribbon.

7. The balloon anchor of claim 5 wherein the hook is generally U-shaped defining a base and a leg, and wherein the leg extends toward the spool.

8. The balloon anchor of claim 5 wherein each of the flanges has a perimeter, and further comprising a second notch located along the perimeter of at least one of the flanges.

9. The balloon anchor of claim 5 further comprising a second notch located on the first side of the cutout section of at least one of the flanges.

10. A balloon anchor comprising:

a spool having opposing sides;

a pair of opposing flanges, one flange extending from each opposing side of the spool;

each flange having a plurality of cutout sections, each cutout section on one flange being substantially in registration with a cutout on the opposing flange, each cutout section having a first side and a second side and a notch, wherein said notch is located on a winding surface of the spool; and a hook extending from the second side of each cutout section.

11. The balloon anchor of claim 10 wherein the spool is adapted to receive a ribbon.

12. The balloon anchor of claim 10 wherein the hook is generally U-shaped defining a base and a leg, and wherein the leg extends toward the spool.

13. The balloon anchor of claim 10 wherein each of the flanges has a perimeter, and further comprising a second notch located along the perimeter of at least one of the flanges.

14. The balloon anchor of claim 10 further comprising a notch located on the first side of at least one cutout section of one of the flanges.

15. A balloon anchor comprising:

a spool having opposing sides;

a pair of flanges, one flange extending from each opposing side of the spool;

one of the flanges having three or more cutout sections, each cutout section having a first side and a second side, and a notch, wherein said notch is located on a winding surface of the spool; and a hook extending from the second side of each cutout section.

16. The balloon anchor of claim 15 wherein the spool is adapted to receive a ribbon.

17. The balloon anchor of claim 15 wherein the hook is generally U-shaped defining a base, and a leg, and wherein the leg extends toward the spool.

18. The balloon anchor of claim 15 wherein each of the flanges has a perimeter, and further comprising a second notch located along the perimeter of at least one of the flanges.

19. The balloon anchor of claim 15 further comprising a second notch located on the first side of at least one cutout section.

* * * * *